United States Patent [19]

Nakazono et al.

[11] 4,143,738

[45] Mar. 13, 1979

[54] LOUDSPEAKER DRIVER UNIT

[75] Inventors: Jiro Nakazono; Akihiko Kodama; Yukio Tsuchiya, all of Tokorozawa, Japan

[73] Assignee: Pioneer Electronic Corporation, Tokyo, Japan

[21] Appl. No.: 872,708

[22] Filed: Jan. 26, 1978

[30] Foreign Application Priority Data

Jan. 29, 1977 [JP] Japan ..... 52-9662[U]

[51] Int. Cl.[2] ..... G10K 13/00; H04R 7/00

[52] U.S. Cl. ..... 181/159; 179/115.5 H

[58] Field of Search ..... 181/159, 152, 150, 185; 179/115.5 H

[56] References Cited

U.S. PATENT DOCUMENTS

| | | | |
|---|---|---|---|
| 2,037,187 | 4/1936 | Wente | 179/115.5 H |
| 2,107,757 | 2/1938 | Kinsley | 181/159 |
| 2,907,837 | 10/1959 | Brami | 179/115.5 H |
| 2,942,071 | 6/1960 | Witchey | 181/159 |
| 3,852,529 | 12/1974 | Schafft | 181/159 |
| 3,991,286 | 11/1976 | Henricksen | 179/115.5 H |
| 4,050,541 | 9/1977 | Henricksen | 181/159 |

FOREIGN PATENT DOCUMENTS

| | | | |
|---|---|---|---|
| 654364 | 6/1951 | United Kingdom | 179/115.5 H |
| 784147 | 10/1957 | United Kingdom | 179/115.5 H |

*Primary Examiner*—Stephen J. Tomsky

*Attorney, Agent, or Firm*—Sughrue, Rothwell, Mion, Zinn and Macpeak

[57] ABSTRACT

A driver unit for a horn type loudspeaker is disclosed. The driver unit comprises a dome-shaped diaphragm and an equalizer positioned on the concave side of the diaphragm. The equalizer has a convex surface adjacent the diaphragm and a plurality of slits extending from the convex surface to an interior, outwardly opening throat. The slits are disposed in equal angular pitch with the outermost slits being located at the edge of the convex surface of the equalizer. The outermost slits are approximately one half the width of the remaining slits, the remaining slits being of equal width.

1 Claim, 4 Drawing Figures

LOUDSPEAKER DRIVER UNIT

BACKGROUND OF THE INVENTION

This invention relates to driver units employed for horn type loudspeakers, and more particularly to an improvement of an equalizer in a driver unit.

A driver unit is used to drive a horn type loudspeaker. A driver unit in which tones are produced from the concave side of a dome-shaped diaphragm is well known in the art as a driver unit having high performance. However, the driver unit of this type still suffers from a disadvantage that the spread of produced tones in the high tone range connot reach its ideal value because of the air which is leaked out of the gap between the inner side of the voice coil and the center pole. In order ot overcome this difficulty, or to eliminate the effect of the air leakage between the inner side of the voice coil and the center pole, a method in which slits are formed in the peripheral portion of the equalizer has been proposed. However, in practice, even with the slits, it is still difficult to improve the spread of produced tones in the high tone range and to provide a smoothly extended frequency response characeristic.

SUMMARY OF THE INVENTION

Accordingly, an object of this invention is to provide a driver unit having an excellent frequency response characteristic and accordingly a horn type loudspeaker which is high in performance. This is accomplished by the distances between slits formed in the equalizer and the positions thereof being so designed as to improve the spread of produced tones in the high tone range.

DETAILED DESCRIPTION OF THE INVENTION

Figure 1:
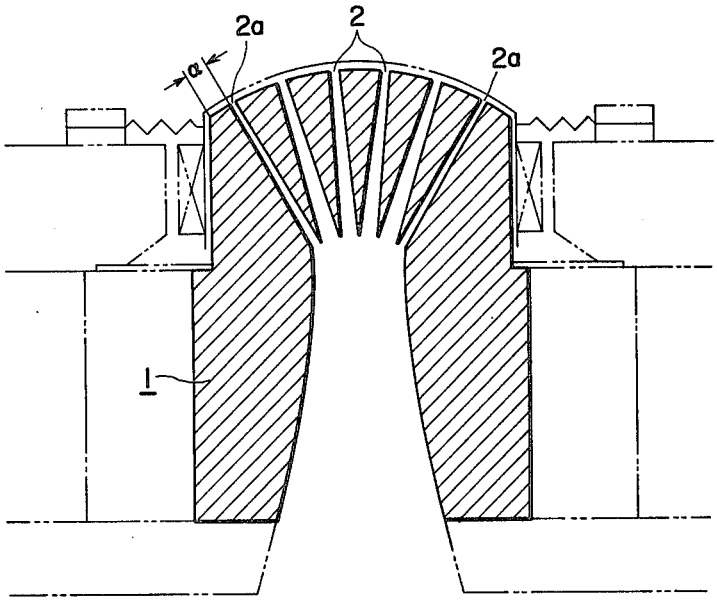
FIG. 1 PRIOR ART
FIG. 1 is a sectional view showing a Bob Smith type equalizer.

As conducive to a full understanding of this invention, a Bob Smith type driver unit, which is a typical one of the conventional driver units, will be described, with reference to FIG. 1. In the driver unit shown in FIG. 1, an equalizer 1 which is one of the components forming the driver unit is provided with slits 2 equal in width and equal in angular pitch, and outermost slits 2*a* which are disposed inwardly by a distance $\alpha$ from the edge of the convex surface of the equalizer 1.

Figure 2:
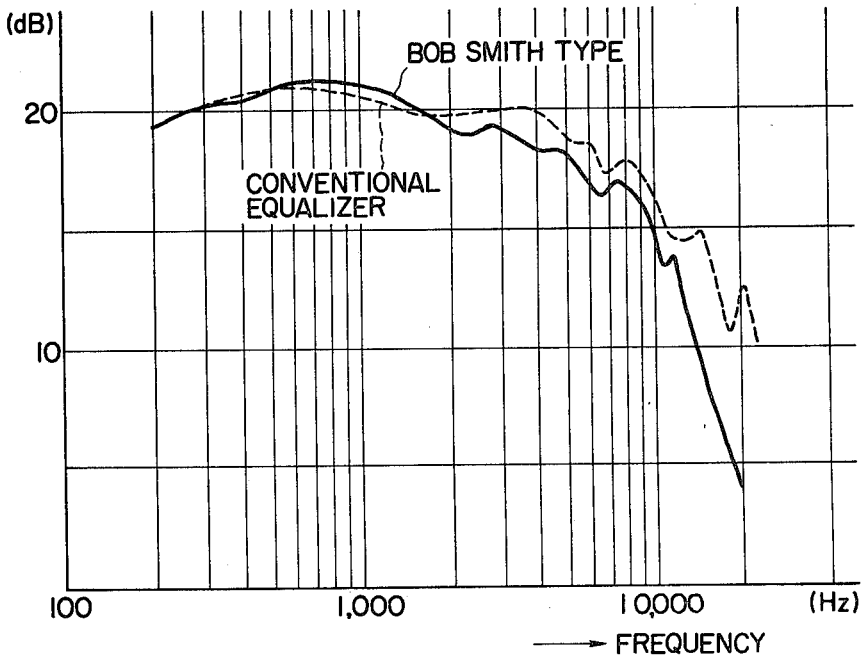
FIG. 2 PRIOR ART
FIG. 2 is a graphical representation indicating the characteristic curve of a horn type loudspeaker provided with the equalizer shown in FIG. 1.

The outermost slits 2*a* of the equalizer 1 have a width proportional to the amount of air in a range for which the slits are responsible, that is, a width proportional to the area of the diaphragm. Shown in FIG. 2 with a solid line is the characteristic curve of a horn type loudspeaker with the above-described equalizer (Bob Smith type). Shown in the same figure with a dotted line is the characteristic curve of the same type loudspeaker with another conventional equalizer in which outermost slits are provided but the widths thereof are equal to those of the other slits. According to the characteristic curves, the acoustic pressure decreases starting at approximately 3,000 Hz, but there are several peaks in the curve above 3,000 Hz. Since it is desirable that the acoustic pressure decrease smoothly with increasing frequency, the characteristic curves shown in FIG. 2 are considerably different from the ideal characteristic curve.

Figure 3:
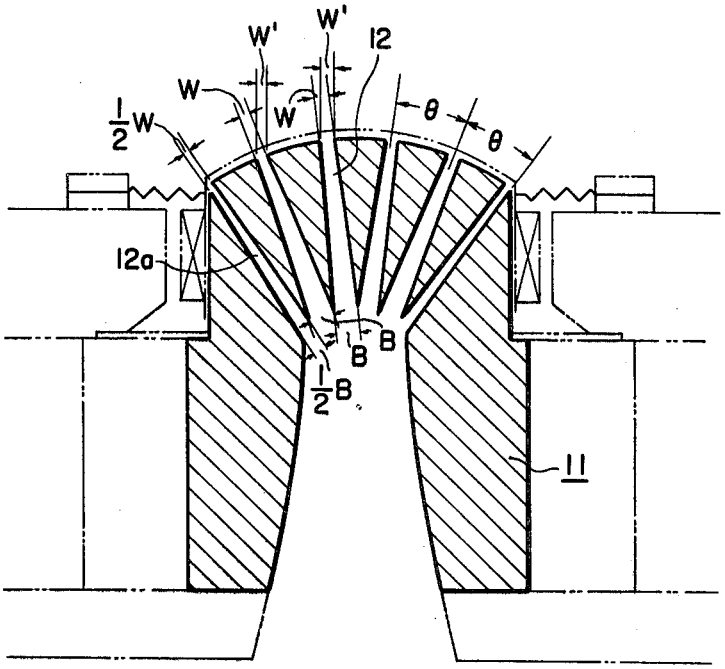
FIG. 3 is a sectional view showing an equalizer forming a driver according to this invention.

In a driver unit and accordingly an equalizer according to this invention, all of the slits 12 provided in the equalizer 11, as shown in FIG. 3, are disposed in equal angular pitch; however, the outermost slits 12*a* are positioned at the outermost edges of the equalizer 11, and each of the outermost slits 12*a* has a width ($\frac{1}{2}$W) which is half of the width (W) of the other slits 12, W being in general, 1 mm.

The width of the outermost slit 12*a* is made to be a half of the width of the slit 12 for the following reason. Each of the regions for which within the interior, outwardly opening throat of the equalizer slits 12 are responsible is a region "B", while each of the regions for which the outermost slits 12*a* are responsible is necessarily a half of the region "B" ($\frac{1}{2}$ B). Therefore, if the width of each slit is made to be proportional to its responsible region, the width of the outermost slit 12*a* will be $\frac{1}{2}$ W when it is assumed that the width of each of the slits 12 is represented by W.

The outermost slits 12*a* are positioned at the outermost edges of the curved surface of the equalizer to be as close as possible to the voice coil. Therefore, the outermost slits 12*a* can catch high tones which are not damped, which leads to an improvement of the tonal spread in the high tone range.

Figure 4:
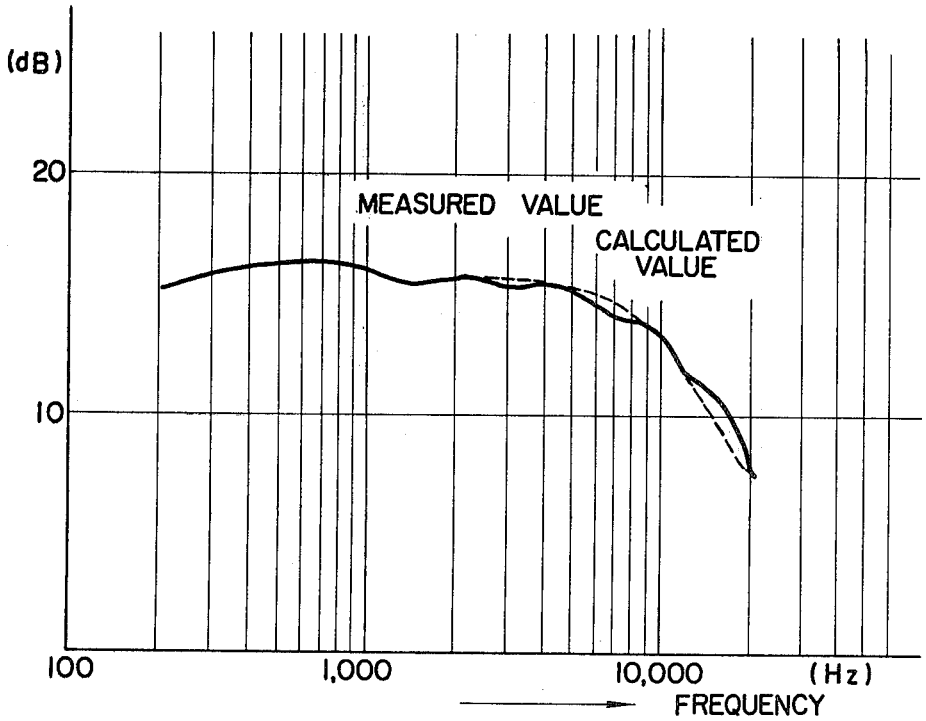
FIG. 4 is a graphical representation indicating the characteristic curve of a horn type loudspeaker using the equalizer shown in FIG. 3.

Shown in FIG. 4 is the characteristic curve of a horn type loudspeaker provided with the driver unit according to the invention. As is apparent from the characteristic curve, the obtained characteristic curve is very close to a curve (calculated values) obtained by calculation, and the tonal spread in the high tone range is excellent.

All that is necessary for the width of the outermost slit 12*a* in the driver unit according to the invention is to be a half of the value between the actual width W shown in FIG. 3 and a projection width W' which is obtained by projecting the actual width onto a plane. That is, the width of the outermost slit 12*a* is not strictly limited to $\frac{1}{2}$ W, but includes approximately $\frac{1}{2}$ W.

As is apparent from the above description, in the driver unit according to the invention, the outermost slits out of the multiple slits provided in the equalizer are opened at the outermost edges thereof, and the width of each of the outermost slits is made to be approximately half of the width of the other slits. Thus, a horn type loudspeaker which is excellent in frequency response characteristic and in which the spread of produced tones in the high tone range is improved is provided according to the invention.

What is claimed is:

1. In a driver unit for a horn type loudspeaker of the type comprising a dome-shaped diaphragm and an equalizer positioned on the concave side of said diaphragm, said equalizer having a convex surface adjacent said diaphragm and a plurality of slits extending from said convex surface to an interior, outwardly opening throat, said slits being disposed in equal angular pitch and, except for the outermost slits adjacent the edge of the convex surface of said equalizer, being equal in width, the improvement wherein said outermost slits are disposed at the edge of the convex surface of said equalizer and the width of said outermost slits is approximately one half the width of the remaining slits.

* * * * *